US012241317B2

(12) United States Patent
Ortiz et al.

(10) Patent No.: US 12,241,317 B2
(45) Date of Patent: Mar. 4, 2025

(54) DISCONNECTION OF TOOL STRING SECTIONS IN A SUBTERRANEAN WELL

(71) Applicant: KING SOUTHWEST & CONSULTING OF CYPRESS, Houston, TX (US)

(72) Inventors: Santos D. Ortiz, Houston, TX (US); George R. King, Houston, TX (US)

(73) Assignee: KING SOUTHWEST & CONSULTING OF CYPRESS, Houston, TX (US)

( * ) Notice: Subject to any disclaimer, the term of this patent is extended or adjusted under 35 U.S.C. 154(b) by 0 days.

(21) Appl. No.: 18/412,754

(22) Filed: Jan. 15, 2024

(65) Prior Publication Data

US 2024/0240532 A1 Jul. 18, 2024

Related U.S. Application Data

(60) Provisional application No. 63/480,037, filed on Jan. 16, 2023.

(51) Int. Cl.
*E21B 17/02* (2006.01)
*E21B 19/16* (2006.01)

(52) U.S. Cl.
CPC ..... *E21B 19/16* (2013.01); *E21B 17/028* (2013.01)

(58) Field of Classification Search
CPC ..... E21B 19/16; E21B 17/028
See application file for complete search history.

(56) References Cited

U.S. PATENT DOCUMENTS

| | | | | |
|---|---|---|---|---|
| 4,035,092 | A | 7/1977 | Adams, Jr. | |
| 4,624,308 | A | 11/1986 | White | |
| 4,648,444 | A | 3/1987 | Busch | |
| 4,697,641 | A | 10/1987 | White | |
| 4,706,744 | A | 11/1987 | Smith et al. | |
| 4,759,406 | A | 7/1988 | Smith et al. | |
| 5,109,921 | A | 5/1992 | Aracena | |
| 5,392,851 | A | 2/1995 | Arend | |
| 5,984,006 | A * | 11/1999 | Read | E21B 17/06 285/376 |
| 7,290,748 | B2 | 11/2007 | Mcdonald | |
| 9,322,225 | B2 | 4/2016 | Mogedal et al. | |
| 9,869,138 | B2 | 1/2018 | Vanegas et al. | |
| 10,329,850 | B2 | 6/2019 | Nicholson | |
| 11,608,691 | B2 | 3/2023 | King et al. | |
| 11,808,092 | B2 | 11/2023 | King et al. | |
| 2002/0000320 | A1 * | 1/2002 | Gissler | E21B 47/092 166/241.5 |

(Continued)

FOREIGN PATENT DOCUMENTS

WO WO-2023205178 A1 * 10/2023

*Primary Examiner* — Steven A Macdonald
(74) *Attorney, Agent, or Firm* — Smith IP Services, P.C.

(57) ABSTRACT

A disconnect tool can include an electrical motor and a weak link. The electrical motor can be configured to part the weak link in response to electrical power applied to the electrical motor. A method of disconnecting sections of a tool string from each other in a well can include connecting a disconnect tool in the tool string, the disconnect tool including an electrical motor and a weak link, conveying the tool string into the well, and then applying electrical power to the electrical motor, thereby parting the weak link and disconnecting the tool string sections.

22 Claims, 7 Drawing Sheets

(56) References Cited

U.S. PATENT DOCUMENTS

| | | | | |
|---|---|---|---|---|
| 2003/0102132 | A1* | 6/2003 | Estep | E21B 17/06 166/242.6 |
| 2005/0230115 | A1 | 10/2005 | Rose | |
| 2007/0023191 | A1 | 2/2007 | Dreggevik | |
| 2008/0053654 | A1 | 3/2008 | Ullah et al. | |
| 2011/0174500 | A1* | 7/2011 | Davies | E21B 17/023 439/372 |
| 2012/0132439 | A1* | 5/2012 | Ratcliffe | E21B 17/023 166/377 |
| 2013/0093179 | A1* | 4/2013 | Jenkins | E21B 41/0021 285/1 |
| 2016/0177702 | A1 | 6/2016 | Buck et al. | |
| 2018/0038169 | A1 | 2/2018 | Nicholson | |
| 2020/0248520 | A1* | 8/2020 | Johnsen | E21B 31/18 |
| 2020/0248536 | A1* | 8/2020 | Holodnak | E21B 23/14 |
| 2021/0062589 | A1 | 3/2021 | Kennedy | |

* cited by examiner

DISCONNECTION OF TOOL STRING SECTIONS IN A SUBTERRANEAN WELL

CROSS-REFERENCE TO RELATED APPLICATION

This application claims the benefit of the filing date of U.S. provisional application No. 63/480,037 filed on 16 Jan. 2023. The entire disclosure of the prior application is incorporated herein by this reference.

BACKGROUND

This disclosure relates generally to equipment utilized and operations performed in conjunction with a subterranean well and, in an example described below, more particularly provides for disconnection in a downhole tool string.

It may at times be advantageous to be able to disconnect sections of a well tool string from each other in a subterranean well. The disconnection may be part of a planned well operation (for example, to intentionally deploy one of the tool string sections in the well), or the disconnection may be a contingency measure (for example, due to an unplanned or inadvertent event).

Therefore, it will be readily appreciated that improvements are continually needed in the art of disconnecting sections of a well tool string from each other in a well. The present disclosure provides such improvements to the art, which improvements may be used in a wide variety of different types of well operations for a wide variety of different purposes.

DETAILED DESCRIPTION

Figure 1:
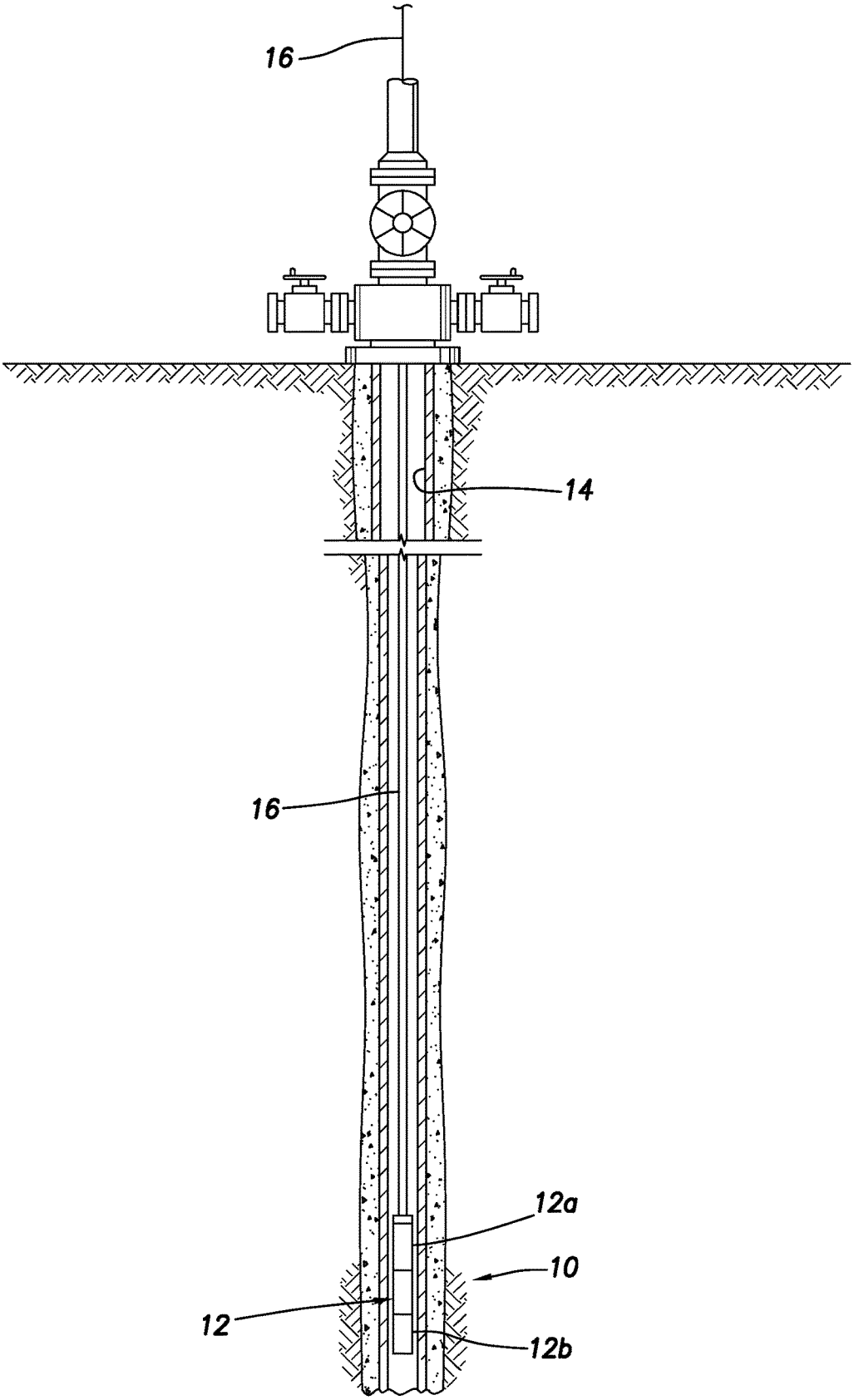
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly or well tool string 12 is conveyed into a wellbore 14 by a conveyance 16. The tool string 12 in this example includes an upper section 12*a* and a lower section 12*b*. Each of the tool string sections 12*a,b* can include one or more well tools (such as, a cable head, a perforator, a casing collar locator, a logging tool, a caliper, or any other type of well tool).

The conveyance 16 could be any of the types known to those skilled in the art as wireline, e-line, slickline, coiled tubing, etc. The scope of this disclosure is not limited to any particular type of conveyance used to convey a bottom hole assembly or well tool string into or through a wellbore.

Unfortunately, in some situations, the tool string 12 can become stuck in the wellbore 14 and it is not possible for the entire tool string to be retrieved from the wellbore using the conveyance 16. For example, in an uncased section of the wellbore 14 an earth formation surrounding the wellbore could cave in, or in a cased section of the wellbore the casing that lines the wellbore could collapse, etc.

As a contingency measure, it would be beneficial to be able to disconnect sections 12*a,b* of the tool string 12 from each other, so that the upper section of the tool string could be retrieved from the wellbore 14 using the conveyance 16, leaving a lower section of the tool string stuck in the wellbore. The lower section 12*b* of the tool string 12 could be retrieved later (for example, in a fishing operation), or the wellbore 14 could be side-tracked around the stuck section if the wellbore is being drilled. However, the scope of this disclosure is not limited to any particular reason or situation that prompts the disconnection of sections of a tool string from each other.

Referring additionally now to FIGS. 2-6, an example of a disconnect tool 20 is representatively illustrated. The disconnect tool 20 may be used in the system 10 and method of FIG. 1, or it may be used in other systems and methods.

The FIGS. 2-6 disconnect tool 20 is depicted as including or incorporating a wireline cable head used to connect the conveyance 16 to the tool string 12 in the FIG. 1 system 10. In this example, the remainder of the tool string 12 would be connected to a lower end of an outer housing assembly 22 of the disconnect tool 20. In other examples, the disconnect tool 20 may not incorporate a wireline cable head. For example, an example of the disconnect tool 20 depicted in FIGS. 7 & 8 and described more fully below could be connected between any two well tools of the tool string 12.

Figure 2:
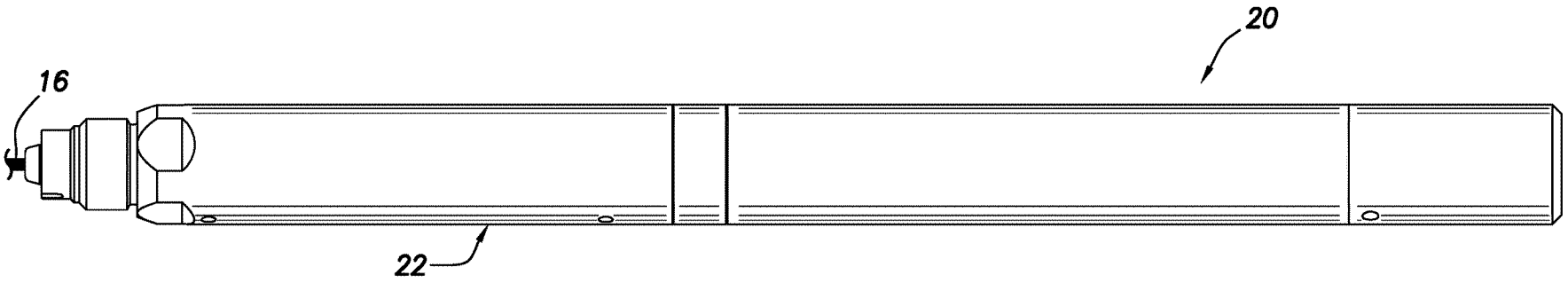
FIG. 2 is a representative side view of an example of a disconnect tool that may be used in the FIG. 1 system and method, and that can embody the principles of this disclosure.
Figure 3:
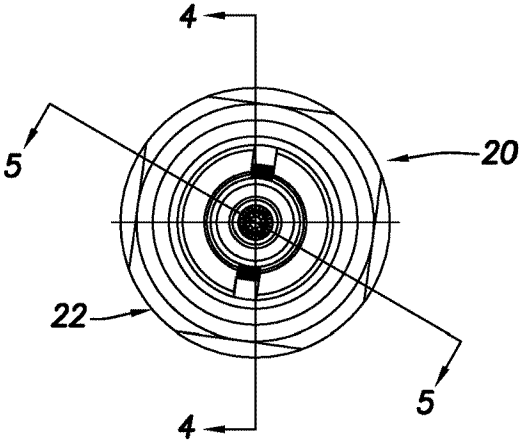
FIG. 3 is a representative top view of the disconnect tool.

In FIGS. 2 & 3, the disconnect tool 20 is depicted as it may be connected as part of the tool string 12. The conveyance is connected at an upper end of the disconnect tool 20. A remainder of the tool string 12 can be connected at a lower end of the disconnect tool 20.

Figure 4:
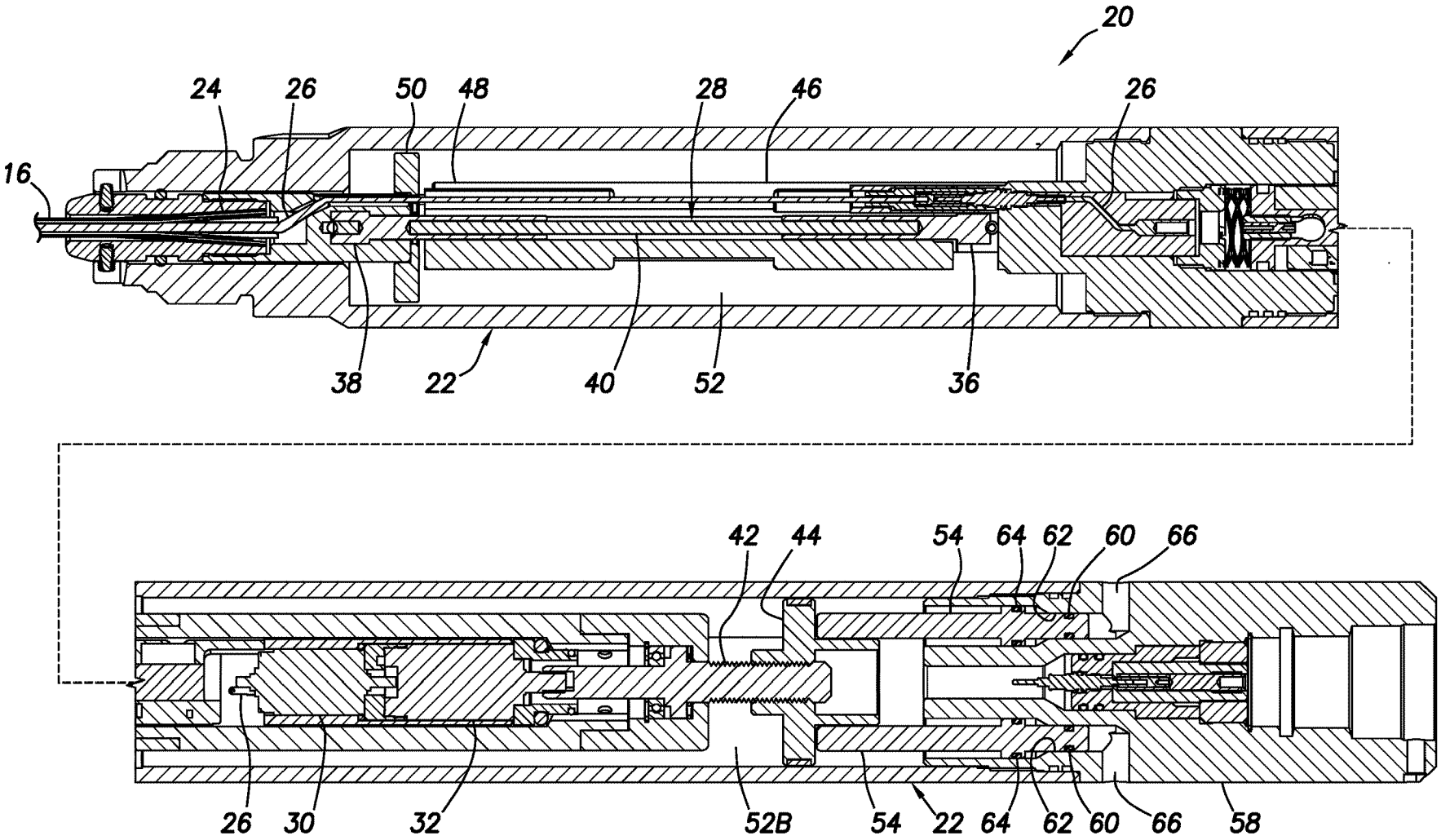
FIG. 4 is a representative cross-sectional view of the disconnect tool, taken along line 4-4 of FIG. 3.
Figure 5:
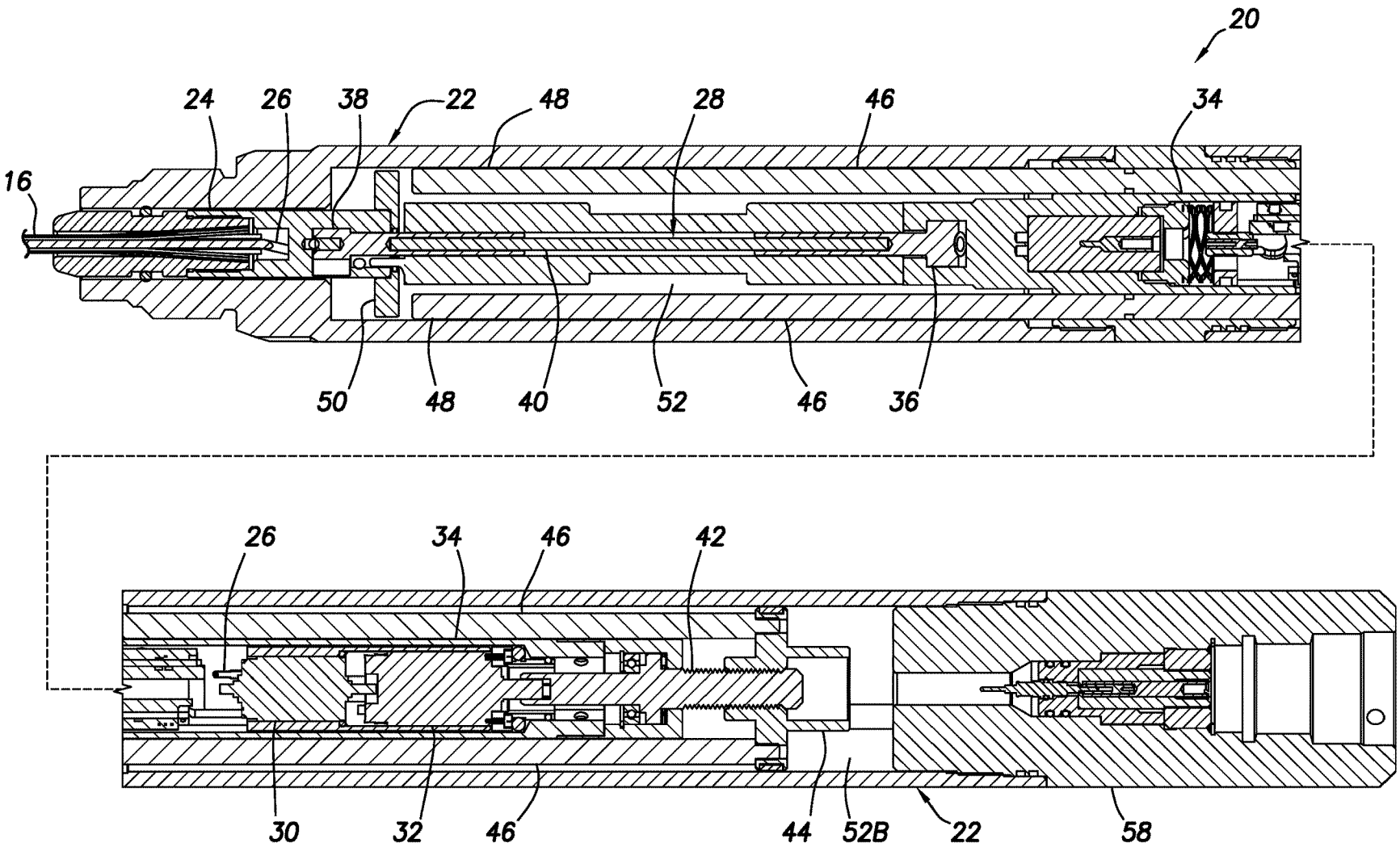
FIG. 5 is a representative cross-sectional view of the disconnect tool, taken along line 5-5 of FIG. 3.

As depicted in FIGS. 4 & 5, the disconnect tool 20 includes a wireline or cable connector 24 in an upper end of the outer housing assembly 22. The connector 24 secures the conveyance 16 (in this example, in the form of a wireline) to the disconnect tool 20.

An electrical line 26 of the wireline 16 extends from the connector 24 past a weak link 28 to an electrical motor 30. The motor 30 and an optional gear reducer 32 are contained in a motor enclosure 34. An upper end of the enclosure 34 is secured to a lower end 36 of the weak link 28. An upper end 38 of the weak link 28 is secured to the connector 24.

In other examples, the arrangement of the motor 30 and the gear reducer 32 can be reversed in the motor enclosure 34. The scope of this disclosure is not limited to any particular arrangement, configuration or combination of components in the disconnect tool 20.

The weak link 28 in this example includes a wire rope 40 extending between the lower and upper ends 36, 38. The wire rope 40 has a known tensile strength, which is preferably less than a tensile strength of the conveyance 16. In other examples, other types of weak links may be used (such as, a solid rod instead of the wire rope). It is not necessary for the weak link 28 to have a tensile strength less than that of the wireline or other conveyance 16.

The weak link 28 may comprise any of the weak link, shock absorber, weak point or material examples described in U.S. Pat. No. 11,608,691. The entire disclosure of this prior patent is incorporated herein by this reference in its entirety for all purposes.

An externally threaded shaft 42 is connected to an output of the gear reducer 32. A lower end of the shaft 42 is threadedly engaged with a support member 44 that supports multiple compression rods 46 that are threaded into the support member. The rods 46 extend upwardly in a space between the motor enclosure 34 and the outer housing assembly 22. If the motor 30 and the gear reducer 32 are reversed in the motor enclosure 34 as described above, the shaft 42 can also be appropriately rearranged in the motor enclosure.

When electrical power is provided to the motor 30 via the electrical line 26, the shaft 42 is caused to rotate. In this example, the gear reducer 32 multiplies a torque output of the motor 30. Due to the threaded engagement between the shaft 42 and the support member 44, the support member and the rods 46 are displaced upward.

Upper ends 48 of the rods 46 are positioned so that, when the rods displace upward, the ends of the rods will engage an abutment 50. The abutment 50 is shouldered against the upper end 38 of the weak link 28. Thus, when electrical power is applied to the motor 30, the upper end 38 of the weak link 28 is biased upward.

Since the lower end 36 of the weak link 28 is secured to the motor enclosure 34, the motor enclosure will react the force applied to the upper end 38 of the weak link. Thus, the ends 36, 38 will be biased in opposite directions and a tensile force will be applied to the wire rope 40.

When the tensile force applied to the wire rope 40 reaches a level corresponding to the tensile strength of the wire rope, the wire rope will part. This will enable the upper end 38 of the weak link 28 and the connector 24 to displace upward out of the outer housing assembly 22. The conveyance 16, connector 24 and the upper end 38 of the weak link 28 can then be retrieved from the well.

Note that the weak link 40 and the motor enclosure 34 are contained in chambers 52, 52B. Pistons 54 received in the outer housing assembly 22 balance the force on the rods 46 due to external borehole pressure.

A step in diameters of the pistons 54 aids the application of a biasing force after a given amount of linear travel. A seal 60 carried on a lower end of each piston 54 is withdrawn from a seal bore 62, thereby venting an atmospheric chamber between seals 60, 64 on the piston. In this manner, well pressure applied via ports 66 in the outer housing assembly 22 assists in biasing the pistons 54, support member 44 and compression rods 46 upward.

Note that the step in diameters of the pistons 54 is not required. In some examples, the pistons 54 and the ports 66 can be provided without the steps, and well pressure acting on the pistons will still act to bias the pistons 54, support member 44 and compression rods 46 upward.

Chamber 52B contains air initially at ambient pressure. Chamber 52 is packed with grease to keep debris out of the chamber and out of contact with the wire rope 40. The chamber 52 is, however, exposed to well pressure via ports 68 in the outer housing assembly 22 (see FIG. 6).

Figure 6:
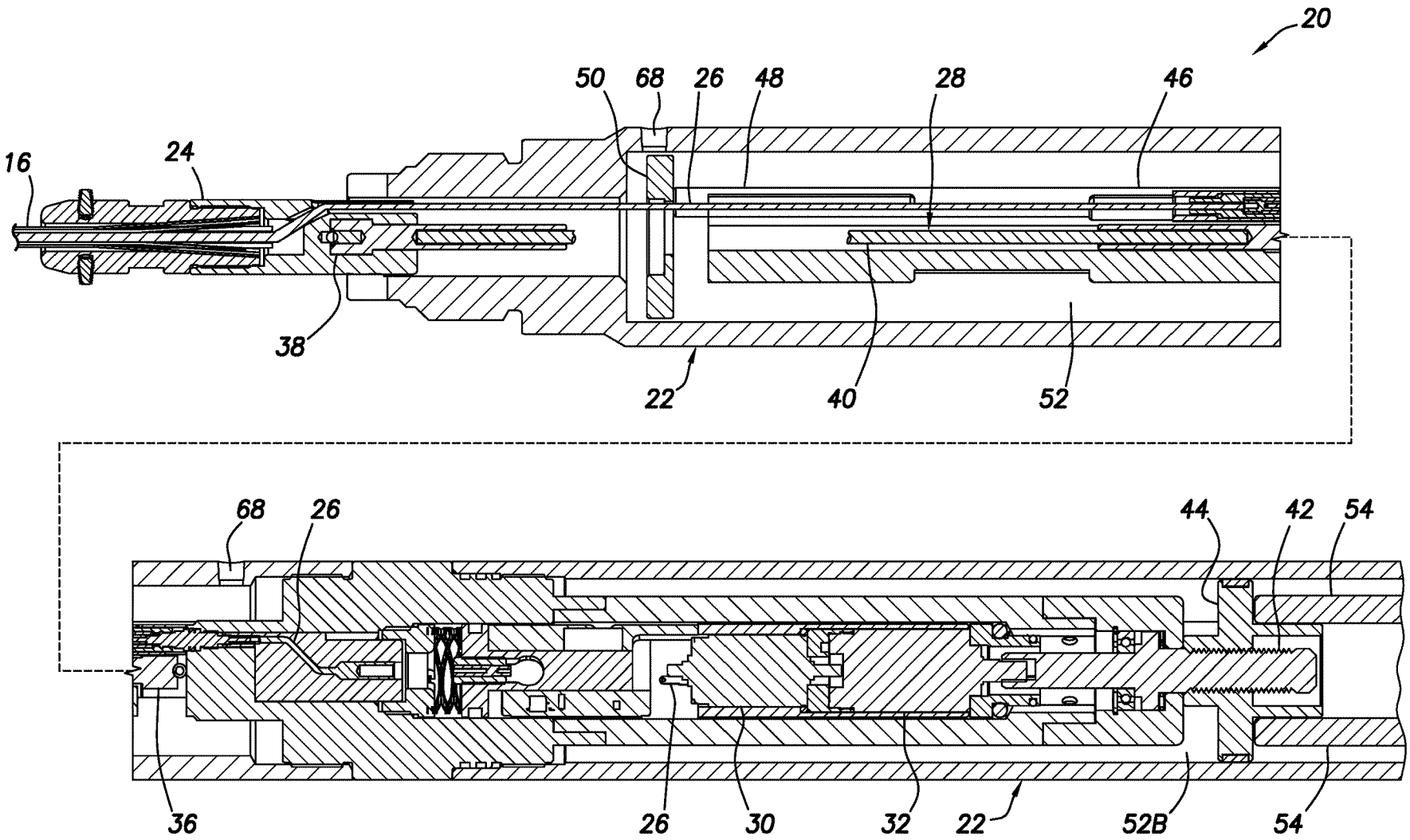
FIG. 6 is a representative cross-sectional view of the disconnect tool in an actuated configuration.

As depicted in FIG. 6, the support member 44 and rods 46 have been displaced upward due to electrical power having been applied to the motor 30, and the weak link lower end 36 is displaced downward after the rods 46 have engaged the abutment 50. The weak link 28 has been parted to thereby permit the conveyance 16, connector 24 and the upper end 38 of the weak link 28 to be retrieved from the well.

Note that the electrical power may be applied directly to the motor 30 via the electrical line 26, or a motor controller (not shown) may be electrically connected between the motor and the electrical line. The motor controller may include a hardware or software "switch" that supplies electrical power to the motor 30 when an appropriate electrical signal is received via the electrical line 26.

Figure 7:
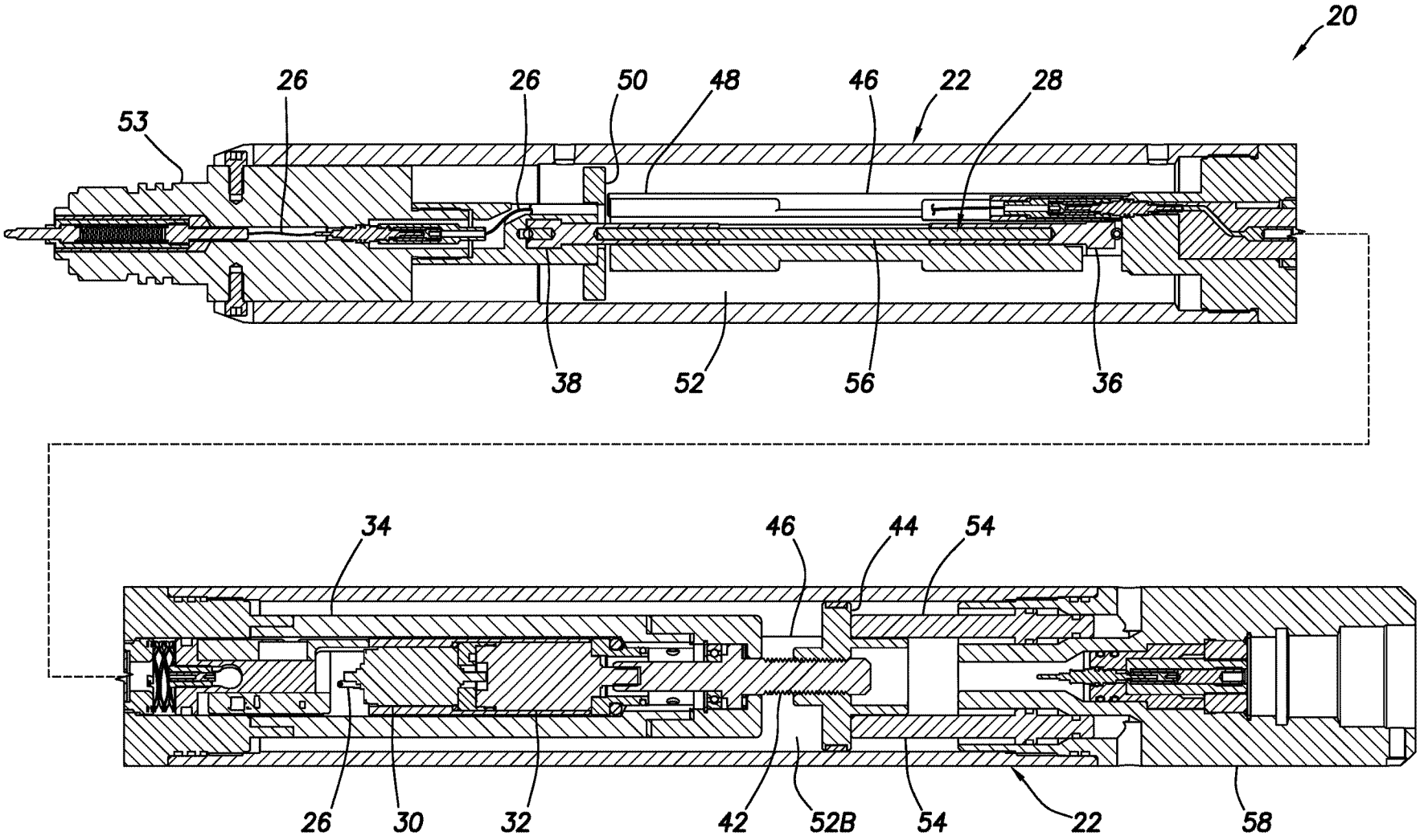
FIG. 7 is a representative cross-sectional view of another example of the disconnect tool in a run-in configuration.
Figure 8:
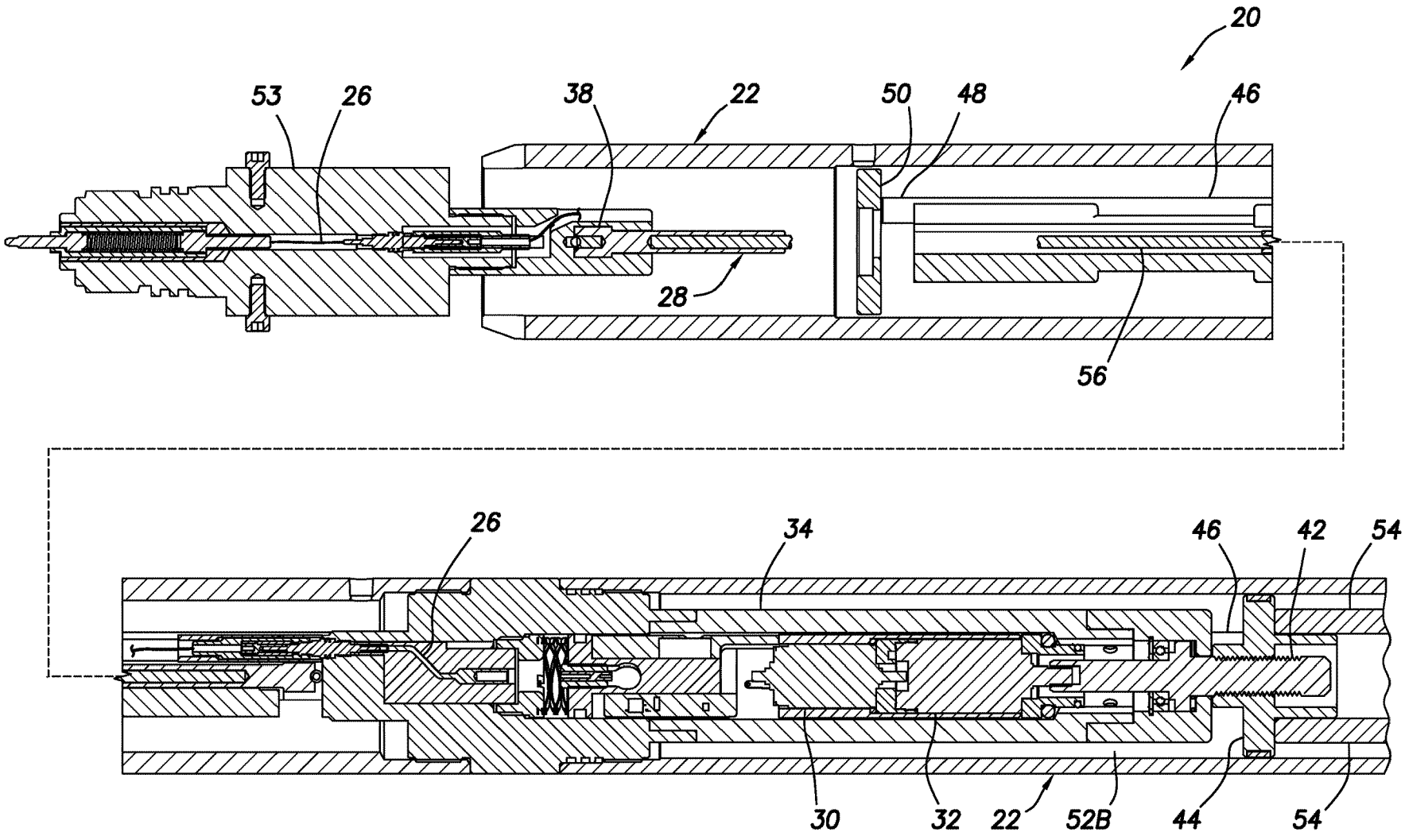
FIG. 8 is a representative cross-sectional view of the FIG. 7 disconnect tool in an actuated configuration.

Referring now to FIGS. 7 & 8, another example of the disconnect tool 20 is representatively illustrated. In this example, the disconnect tool 20 is not configured as including a cable head, but is instead configured to be connected between two well tools in the tool string 12 of the FIG. 1 system 10. However, the FIGS. 7 & 8 disconnect tool 20 can be used in other systems and methods in keeping with the scope of this disclosure.

The FIGS. 7 & 8 disconnect tool 20 is similar in most respects to the FIGS. 2-6 disconnect tool. One difference is that, instead of the connector 24, the FIGS. 7 & 8 disconnect tool 20 includes a well tool connector 53 configured to connect to a well tool of a tool string. Thus, when electrical power is applied to the motor 30 and the weak link 28 parts, the well tool connected to the upper connector 53 can be retrieved from the well, while another well tool connected to a lower well tool connector 58 of the disconnect tool 20 remains in the well.

Another difference in the FIGS. 7 & 8 disconnect tool 20 is that the weak link 28 includes a solid rod 56 connected between the ends 36, 38. The rod 56 could be necked down (e.g., with a reduced diameter portion) or otherwise configured as desired to produce a known tensile strength of the rod.

The FIGS. 7 & 8 example of the disconnect tool 20 operates in essentially the same manner as the FIGS. 2-6 example. In FIG. 8, the disconnect tool 20 is depicted in its configuration after electrical power has been applied to the motor 30, the lower end 36 is displaced downward after the rods 46 have engaged the abutment 50, the weak link 28 has been parted to thereby permit the upper well tool connector 53 and the upper end 38 of the weak link 28 to be retrieved from the well.

It may now be fully appreciated that the above disclosure provides significant advancements to the art. A disconnect tool 20 and method are described above, in which electrical power applied to a motor 30 causes a weak link 28 to part.

Either a connector 24 used to connect a conveyance 16 to the disconnect tool 20, or a connector 58 used to connect a well tool to the disconnect tool 20, is released for retrieval from a well in response to the parting of the weak link 28.

The electrical power applied to the motor 30 causes linear displacement of a support member 44. The support member 44 is connected to a compression member 46, and a compressive force is applied to the compression member in response to the linear displacement of the support member. A tensile force is applied in the weak link 28 in response to the compressive force being applied to the compression member 46.

A shaft 42 is rotated by the motor 30, and rotation of the shaft causes a tensile force to be applied to the weak link 28. The shaft 42 is rotated by the motor 30 via a gear reducer 32.

The motor 30 is enclosed in an enclosure 34 secured to one end 36 of the weak link 28, and the enclosure displaces in response to the electrical power being applied to the motor. The ends 36, 38 of the weak link 28 are biased in opposite directions in response to the electrical power being applied to the motor 30.

The above disclosure provides to the art a disconnect tool 20 for use in a subterranean well. In one example, the disconnect tool 20 can comprise an electrical motor 30 and a weak link 28. The electrical motor 30 is configured to part the weak link 28 in response to electrical power applied to the electrical motor.

The disconnect tool 20 can include a connector 24 configured to connect a conveyance 16 to the disconnect tool. The connector 24 may be configured to release in response to the electrical power applied to the electrical motor 30.

The disconnect tool 20 can include a connector 53 configured to connect a well tool (e.g., included in the section 12*a* of the tool string 12 of FIG. 1) to the disconnect tool. The connector 53 may be configured to release in response to the electrical power applied to the electrical motor 30.

The disconnect tool 20 can include a support member 44. The support member 44 may be configured to displace linearly in response to the electrical power applied to the electrical motor 30.

The disconnect tool 20 can include a compression member (such as, compression rods 46). The compression member 46 may be configured to transmit a compressive force in response to linear displacement of the support member 44. A tensile force may be applied to the weak link 28 in response to the compressive force being transmitted by the compression member 46.

The disconnect tool 20 can comprise at least one piston 54. The piston 54 may be configured to apply a biasing force to the support member 44 and/or the compression member 46.

The disconnect tool 20 can include a shaft 42. The shaft 42 may be configured to rotate in response to the electrical power applied to the electrical motor 30. A tensile force may be applied to the weak link 28 in response to rotation of the shaft.

The electrical motor 30 may be received in an enclosure 34 secured to one end 38 of the weak link 28. The enclosure 34 may be configured to displace in response to the electrical power applied to the electrical motor 30.

Opposite ends 36, 38 of the weak link 28 may be biased in opposite directions in response to the electrical power applied to the electrical motor 30.

The above disclosure also provides to the art a method of disconnecting first and second sections 12*a,b* of a tool string 12 from each other in a subterranean well. In one example, the method can comprise: connecting a disconnect tool 20 in the tool string 12, the disconnect tool comprising an electrical motor 30 and a weak link 28; conveying the tool string into the well; and then applying electrical power to the electrical motor, thereby parting the weak link and disconnecting the tool string first section 12*a* from the tool string second section 12*b*.

In the disconnecting step, the tool string first section 12*a* may comprise a connector 24 that connects a conveyance 16 to the disconnect tool 20. In another example, the tool string first section 12*a* may comprise a connector 53 that connects a well tool (part of the tool string first section 12*a*) to the disconnect tool 20.

The electrical power applying step may comprise linearly displacing a support member 44 of the disconnect tool 20. The linearly displacing step may comprise applying a compressive force to a compression member 46 of the disconnect tool 20. The compressive force applying step may comprise applying a tensile force to the weak link 28. The method may include applying a biasing force to the support member 44 and/or the compression member 46 in response to well pressure applied to at least one piston 54 of the disconnect tool 20.

The electrical power applying step may comprise rotating a shaft 42 of the disconnect tool 20. The rotating step may comprise applying a tensile force to the weak link 28.

The method may include containing the electrical motor 30 in a motor enclosure 34, and connecting an end 36 of the weak link 28 to the motor enclosure. The applying step may comprise displacing the motor enclosure 34.

The electrical power applying step may comprise biasing ends 36, 38 of the weak link 28 in opposite directions in response to the electrical power applying.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A disconnect tool for use in a subterranean well, the disconnect tool comprising:

an electrical motor;

a support member configured to displace linearly in response to the electrical power applied to the electrical motor;

at least one piston configured to apply a biasing force to the support member; and a weak link, in which the electrical motor is configured to part the weak link in response to electrical power applied to the electrical motor.

2. The disconnect tool of claim 1, further comprising a connector configured to connect a conveyance to the disconnect tool, and in which the connector is configured to release in response to the electrical power applied to the electrical motor.

3. The disconnect tool of claim 1, further comprising a connector configured to connect a well tool to the disconnect tool, and in which the connector is configured to release in response to the electrical power applied to the electrical motor.

4. The disconnect tool of claim 1, further comprising a compression member, and in which the compression member is configured to transmit a compressive force in response to linear displacement of the support member.

5. The disconnect tool of claim 4, in which a tensile force is applied to the weak link in response to the compressive force being transmitted by the compression member.

6. The disconnect tool of claim 4, in which the piston is configured to apply a biasing force to the compression member.

7. The disconnect tool of claim 1, further comprising a shaft, and in which the shaft is configured to rotate in response to the electrical power applied to the electrical motor.

8. The disconnect tool of claim 7, in which a tensile force is applied to the weak link in response to rotation of the shaft.

9. The disconnect tool of claim 1, in which ends of the weak link are biased in opposite directions in response to the electrical power applied to the electrical motor.

10. A disconnect tool for use in a subterranean well, the disconnect tool comprising:

an electrical motor; and a weak link, in which the electrical motor is configured to part the weak link in response to electrical power applied to the electrical motor, and in which the electrical motor is received in an enclosure secured to one end of the weak link, and in which the enclosure is configured to displace in response to the electrical power applied to the electrical motor.

11. A method of disconnecting first and second sections of a tool string from each other in a subterranean well, the method comprising:

connecting a disconnect tool in the tool string, the disconnect tool comprising an electrical motor and a weak link;

conveying the tool string into the well; and then applying electrical power to the electrical motor, thereby parting the weak link and disconnecting the tool string first section from the tool string second section.

12. The method of claim 11, in which, in the disconnecting step, the tool string first section comprises a connector that connects a conveyance to the disconnect tool.

13. The method of claim 11, in which, in the disconnecting step, the tool string first section comprises a connector that connects a well tool to the disconnect tool.

14. The method of claim 11, in which the applying comprises linearly displacing a support member of the disconnect tool.

15. The method of claim 14, further comprising applying a biasing force to the support member in response to well pressure applied to at least one piston of the disconnect tool.

16. The method of claim 14, in which the linearly displacing comprises applying a compressive force to a compression member of the disconnect tool.

17. The method of claim 16, further comprising applying a biasing force to the compression member in response to well pressure applied to at least one piston of the disconnect tool.

18. The method of claim 16, in which the compressive force applying comprises applying a tensile force to the weak link.

19. The method of claim 11, in which the applying comprises rotating a shaft of the disconnect tool.

20. The method of claim 19, in which the rotating comprises applying a tensile force to the weak link.

21. The method of claim 11, further comprising containing the electrical motor in a motor enclosure, and connecting an end of the weak link to the motor enclosure, and in which the applying comprises displacing the motor enclosure.

22. The method of claim 11, in which the applying comprises biasing ends of the weak link in opposite directions in response to the applying.

* * * * *